United States Patent [19]

Kin et al.

[11] Patent Number: 4,606,730

[45] Date of Patent: Aug. 19, 1986

[54] BIMETAL ELECTRODES FOR SPARK PLUGS OR THE LIKE AND METHOD OF MAKING SAME

[75] Inventors: Nelson I. Kin, Tiffin; William W. Sprau, McCutchenville, both of Ohio

[73] Assignee: The National Machinery Company, Tiffin, Ohio

[21] Appl. No.: 534,483

[22] Filed: Sep. 21, 1983

[51] Int. Cl.[4] ..... H01T 21/02

[52] U.S. Cl. ..... 445/7

[58] Field of Search ..... 445/7

[56] References Cited

U.S. PATENT DOCUMENTS 638,807 12/1899 Holinger ..... 72/267 X 3,857,145 12/1974 Yamaguchi et al. ..... 445/7

FOREIGN PATENT DOCUMENTS 44764 1/1982 European Pat. Off. ..... 455/7

2076706 12/1981 United Kingdom ..... 445/7

*Primary Examiner*—Kenneth J. Ramsey

*Attorney, Agent, or Firm*—Pearne, Gordon, Sessions, McCoy, Granger & Tilberry

[57] ABSTRACT

A method of producing bimetal electrodes in which a core of copper is enclosed within an outer covering of a nickel alloy. The alloy is extruded into a relatively small diameter, deep cup by first forming a cylindrical blank with a rounded indentation in one face and thereafter extruding the cup using a punch having an end conforming with said indentation to form a central opening having a diameter at least three times the diameter of the punch. A cylindrical copper core is then firmly seated within the cup, which is then extruded by two stages to form an elongated, cylindrical blank. In one embodiment, the end is finished by trimming away a flaring skirt portion at the open end and thereafter upsetting the blank. In another embodiment, the flared skirt portion of the nickel alloy is bottled inwardly and pressed flat against the exposed end of the core so that no scrap is produced.

8 Claims, 23 Drawing Figures

BIMETAL ELECTRODES FOR SPARK PLUGS OR THE LIKE AND METHOD OF MAKING SAME

BACKGROUND OF THE INVENTION

This invention relates generally to bimetal electrodes for spark plugs, and more particularly to bimetal electrodes for spark plugs which utilize a heat resisting metal for the exposed portion and a highly thermally conductive material for the core and to novel and improved methods and apparatus for producing such electrodes.

Modern spark ignition internal combustion engines have greatly lengthened periods between service, and it has been recognized that spark plug life is an important factor in determining this interval. In such modern engines, the primary problem of spark plug life becomes that of erosion of the electrodes to a point that the gap increases beyond tolerable limits. In an effort to increase spark plug life by decreasing the erosion of the electrodes, it has been proposed to reduce the electrode temperatures by forming the electrode with an outer surface of a material such as nickel and a core of a highly thermally conductive material such as copper to rapidly conduct the heat away from the firing tip to the exposed end of the spark plug where the heat can be more easily dissipated.

Many methods have been proposed for the manufacture of such electrodes, one of which is disclosed in the application of N. I. Kin and G. T. Payne, Ser. No. 232,954, filed Feb. 9, 1981, and assigned to the assignee of the present invention. In general, this method includes the steps of forming a hollow cup from a heat-resisting metal such as nickel, and thereafter inserting in the open end of the hollow cup a cylindrical slug of a thermally conductive metal such as copper. The copper is then upset within the cup to eliminate all voids, and the resultant composite blank is extruded, closed end first, through a die to reduce the diameter to that of the finished electrode, after which further operations can be performed on the open end, where both the copper and nickel are exposed.

While this method is applicable to metals such as substantially pure nickel, it has not been used successfully with more refractory metals and alloys, which are harder to work but more desirable in a spark plug because of their increased strength and resistance to erosion at high temperatures.

SUMMARY OF THE INVENTION

The present invention provides a method and apparatus for the production of bimetal electrodes utilizing a copper core for its highly thermal conductivity, together with an outer layer of a heat resisting metal such as Inconel or other nickel-base alloy.

In accordance with one aspect of this invention, the nickel-base alloy is cut as a slug from wire and then, during a squaring operation, is provided with a rounded indentation on one end face of the cylindrical blank. During a subsequent operation, a punch having a generally rounded end is used to form the cup by extrusion, and the end of the punch and the indentation on the blank are formed to provide a centering action for the punch to thereby produce a generally deep, small diameter cup having relatively thin walls but with a central cavity having a depth of two or more times the diameter. After the cup has been so formed, a copper slug, also cut from wire, is inserted into the cup and then upset to substantially fill the cavity without voids.

According to another aspect of this invention, the assembled core and cup are thereafter extruded by a two-stage reduction to form the final diameter of the electrode. During the first extrusion operation, the assembled cup and core are inserted, closed end first, into the die and pressed with a punch having a diameter substantially equal to that of the cup, so that at the end of the extrusion operation substantially all of the assembled cup and core have been reduced a first step in diameter, with only the open end portion remaining at the original diameter of the cup.

During the second extrusion operation, the assembly is placed into a die to be reduced in two stages to the final diameter of the electrode, by a punch having a diameter equal to the diameter of the first stage of reduction. During the initial movement of the assembly in the punch, the remaining portion around the open end of the cup and core is reduced in diameter to that of the first drawing operation, after which a further drawing operation is done by further movement of the punch to further extrude the assembled cup and core to the final diameter except for a remaining portion around the upper end, which retains the diameter of the punch. Subsequent to the second extrusion operation, the unreduced ring at the open end may be trimmed and removed, leaving the electrode at its finished diameter for its entire length.

According to another embodiment of the invention, it is possible to form an electrode without the necessity of trimming by a scrapless forming process. Using the same cup as in the first embodiment, a slightly shorter copper core is used so that after the core is upset within the cup during the assembly operation, the end of the copper is recessed a predetermined distance below the open end. The assembled cup and core then proceed through the two-stage extrusion process in substantially the same manner as in the first embodiment, except that a different shaped nose is required on the punch to make up for the reduced volume of copper in the core.

At the end of the second stage of extrusion, the assembly is put in a second die, where the exposed larger diameter of the cup above the copper, instead of being trimmed, is bottled inwardly, and in a subsequent operation pressed flat to substantially seal the copper at the open end so that the finished electrode not only has the nickel-based alloy completely enclosing it and encapsulating the copper core, but also retaining all of the material of the assembly prior to the forming operations.

These and other aspects and advantages of the invention are more fully described in the following detailed description and shown in the accompanying drawings.

DETAILED DESCRIPTION OF THE PREFERRED EMBODIMENTS

Figure 1:
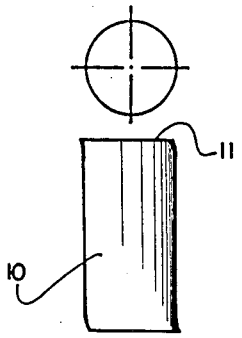
FIGS. 1–3 are views of the progressive steps utilized to form the cup of heat resisting alloy in accordance with the first embodiment of this invention.
Figure 2:
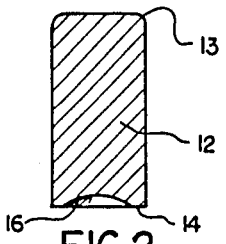
Figure 3:
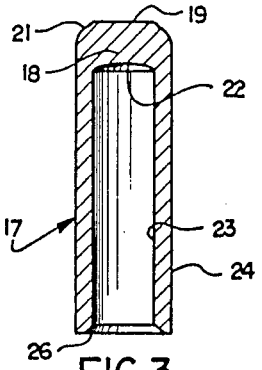

Referring to the drawings in greater detail, FIGS. 1–3 show the progressive stages in forming the cup. The first stage in forming the cup is to cut off a slug or blank 10 from round wire or rod stock, preferably at the initial cut-off of a progressive header. While the cup may be made of any heat resisting metal such as nickel, the methods of the present invention are particularly suitable for alloys that are more difficult to work but have improved heat resisting properties, such as Inconel 600, an alloy of 76% Ni, 16% Cr and 7% Fe. The size of the slug is generally chosen by the amount of material required in the finished electrode, and in a typical example, it has been found that the use of wire about 1½ times the size of the finished electrode, with the length being approximately twice the diameter, provides the proper shape for the slug, which, as is usual in such shearing operations, has oppositely extending, finned ends 11 resulting from the shearing operation.

The second stage in forming the cup is shown in FIG. 2, where the slug 10 has now gone through a squaring operation in a closed die to form the squared slug 12. In the squaring operation, the diameter is increased slightly and the one end is formed with a radiused edge, as shown at 13, while the other end has a generally squared edge 14, and this end is formed with a rounded central recess 16. Preferably, the recess 16 is spherical, with an outer diameter approximately equal to that of the punch used in the subsequent operation. Generally, the spherical radius is approximately equal to the diameter of the slug and, while a spherical recess 16 is preferred, it is recognized that other shapes, such as a parabola, could be used as long as there are no sharp edges or points within the recess.

The final stage in forming the cup is shown in FIG. 3, where the blank of FIG. 2 has been extruded, preferably by closed die extrusion over a punch having an end portion that conforms to the surface of the recess 16. The cup 17 thus has an end wall 18 on the outer side of which is formed a flat circular end face 19 which may be approximately the diameter of the finished electrode. The corners are formed with a radius at 21 generally blending from the end face 19 into the outer surface 24, but it has been found that other shapes in a pure radius may be of advantage, including having the end face 19 project axially slightly beyond the beginning of the radius 21.

The recess within the cup 17 includes an inner end face 22 conforming to the shape of the punch that was used, and generally being spherical in shape, corresponding in shape to the recess 16 formed on the squared slug 12. The recess includes cylindrical inner sides 23 and terminates at an open end indicated at 26. It has been found that by the use of the preformed recess in the slug 12 conforming to the rounded end of the punch, it is possible, even with a material such as Inconel 600, to form a generally small diameter, deep recess in the cup in which the depth of the recess may be as great as three or four times its diameter, which in turn is selected to be slightly greater than the finished outside diameter of the electrode. Such a cup may be formed with a very uniform wall thickness, with the inner side of the bore 23 in close concentricity with the outer surface 24, and it is believed that this is facilitated by the guiding action of the recess 16 on the squared slug 12, tending to prevent deflection of the punch and retaining it in central alignment with respect to the cup.

Figure 4:
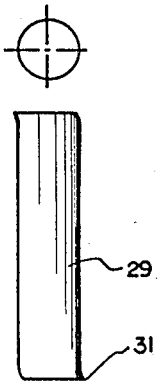
FIGS. 4–6 are views of the progressive steps of forming the core and assembling it within the cup shown in FIG. 3.
Figure 5:
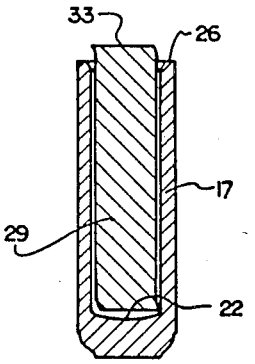

After the extrusion operation in which the finished cups, as shown in FIG. 3, are produced, they are cleaned to remove lubricants and other material, particularly from the inner cavity. In an assembly machine, copper wire is cut off to form core slugs 29, as shown in FIG. 4, with the core slug 29 having an outside diameter slightly less than the inner bore 23 of the cup, particularly to allow clearance for the finned ends 31 from the shearing operation, to allow these core slugs to be easily inserted into the cup without interference between the end fin 31 and the bore 23. Because the core slug 29 does not undergo any squaring operation, it will necessarily be a loose fit, as shown in FIG. 5, with considerable clearance between the core slug and the rounded face 22 at the bottom of the cup. Hence, the core slug 29 is made long enough so that when inserted the full distance without deformation into the cup, the end 33 projects above the open end 26 of the cup and a clearance space exists adjacent both the bottom face of the cup 22 and the sidewalls 23.

After the assembly shown in FIG. 5 is made, there is then performed a staking or seating operation in which no deformation is made to the cup, but the pressure is applied entirely to the core slug 29 within the cup 17 so as to completely fill the space within the cup without any voids or air pockets, either adjacent the end 22 or along the sides adjacent the inner bore 23 of the cup. When this is done, the copper will be slightly recessed below the open end 26, as shown at 34 in FIG. 6. After this step has taken place, the assembled cup and core are ready for further forming actions to produce the finished electrode.

Figure 6:
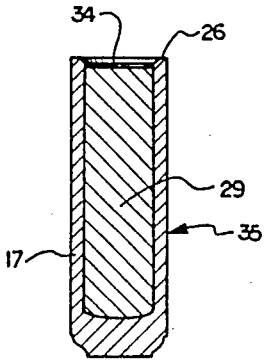
Figure 7:
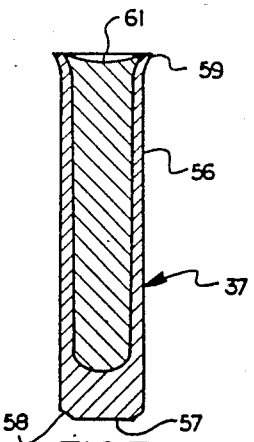
FIGS. 7–10 show the progressive stages in which the assembled cup and core of FIG. 6 are formed into the finished electrode.
Figure 8:
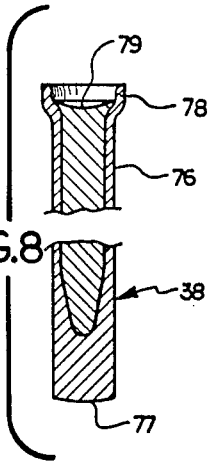
Figure 9:
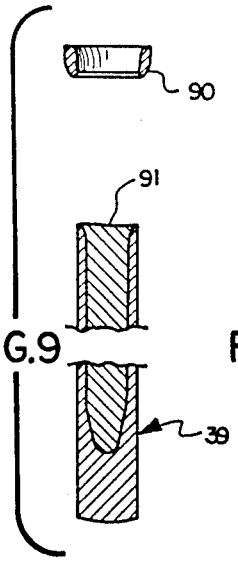

The assembled blank 35 shown in FIG. 6 is formed into a finished electrode, according to one embodiment of the invention, in four stages. The blank is partially reduced in a first extrusion operation to form the blank 37 shown in FIG. 7 and then reduced to the final diameter in a second extrusion operation to produce the blank shown in FIG. 8, which now has a diameter of the finished electrode. The third operation is essentially a trimming operation to form the blank 39 shown in FIG. 9, followed by a final forming operation to form the finished electrode 40 shown in FIG. 10.

Figure 11:
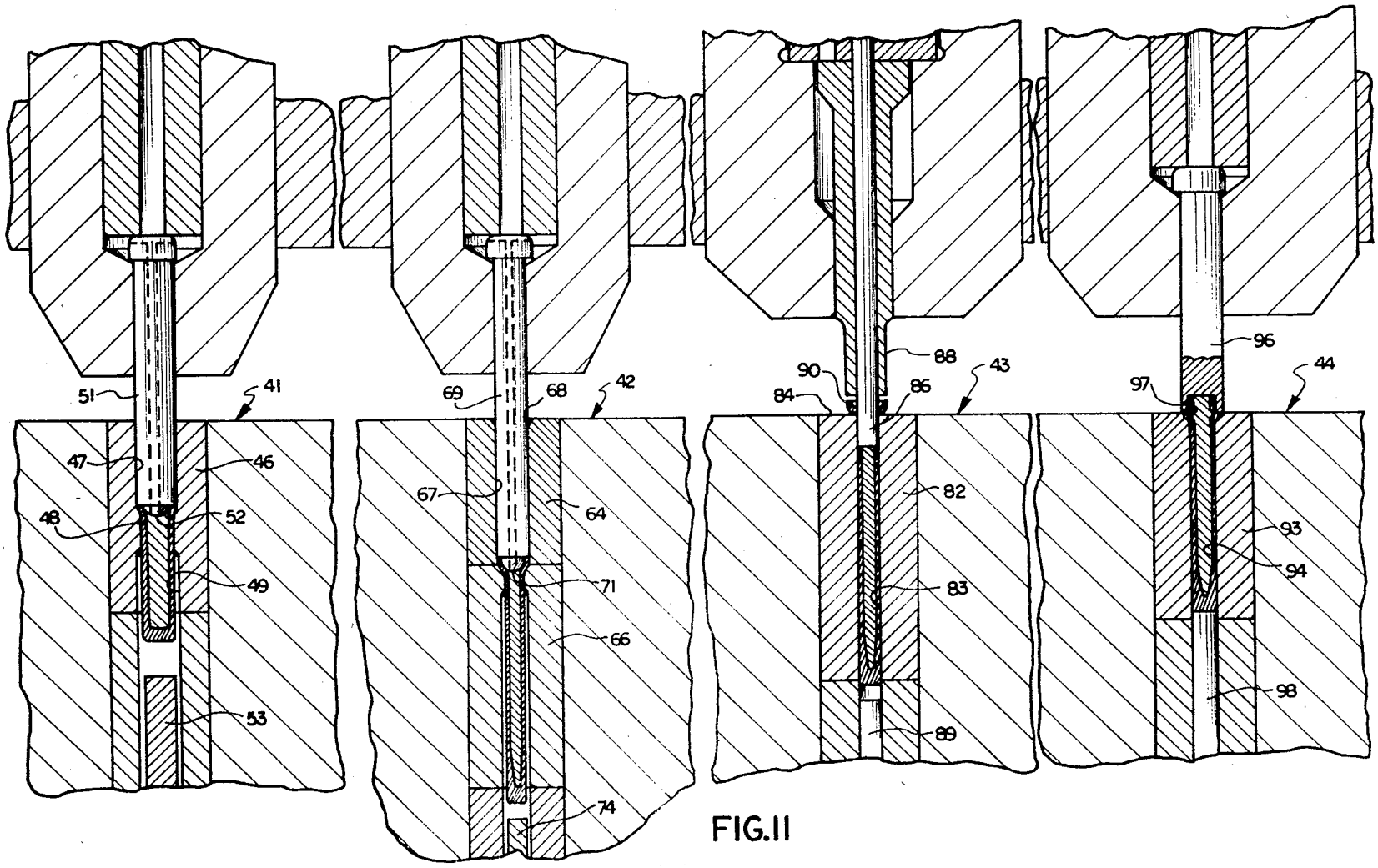
FIG. 11 illustrates one set of tooling utilized to progressively form the parts illustrated in FIGS. 7 through 10.
Figure 11B:
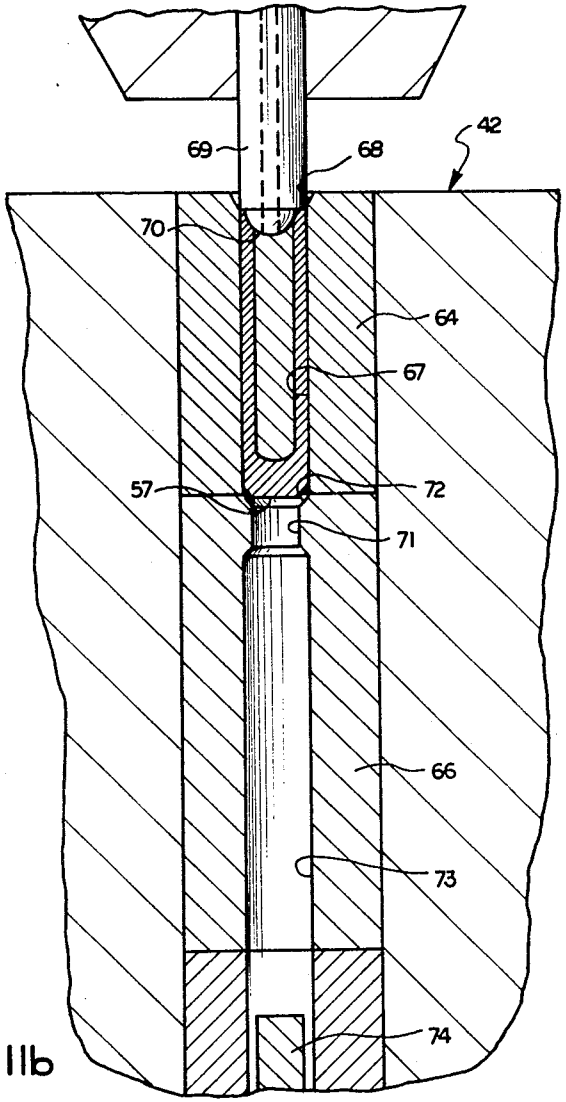
FIGS. 11A and 11B are enlarged, fragmentary views of the steps at the second station of FIG. 11 in transforming the cup and core of FIG. 7 into that of FIG. 8.
Figure 11A:
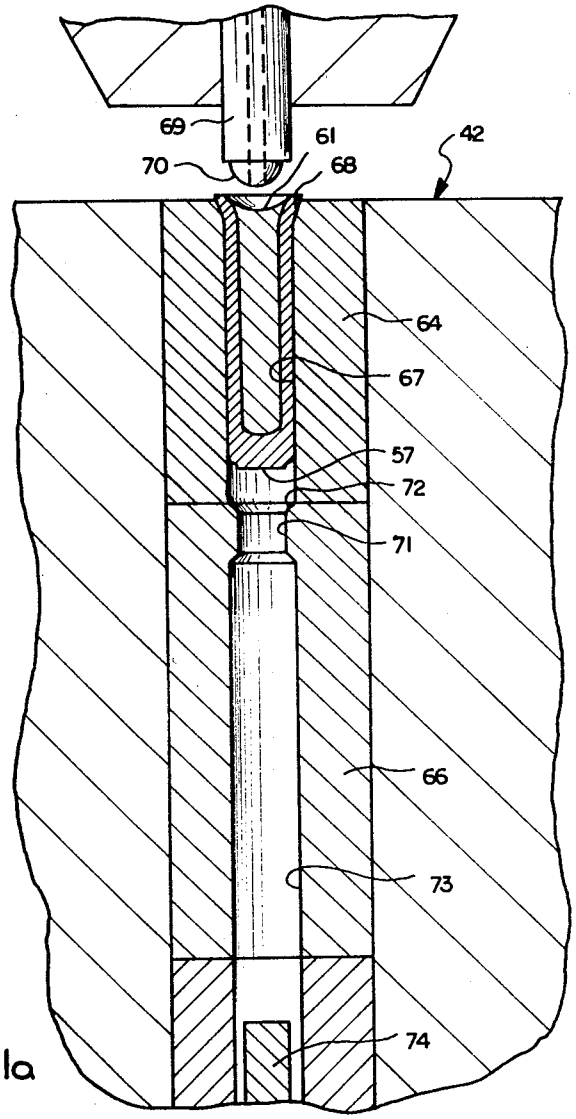

The tooling that is used in the four operations on the assembled blank 35 is shown in FIG. 11, where the blank 37 is produced at the first station 41, while the blank 38 is formed at the second station 42, which is also shown in greater detail in FIGS. 11A and 11B. The trimming operation to form the blank 39 is done at the third station 43, while the final forming operations are done at the fourth station 44.

At the first station 41, the assembled cup and core 35 are picked up by suitable transfer means (not shown) and inserted into an extrusion die 46 having a recess 47 at least as deep as the length of the cup so that the recess 47 will completely receive the assembly before the cup engages the extrusion orifice 48. A punch 51 has a nose portion 52 shaped to generally conform with the recessed end 34 of assembly 35 to guide it in entering the recess 47. The punch 51 has a diameter substantially as great as that of the recess 47 to confine the assembly so that continued forward movement of the punch then forces the assembly through the extrusion orifice 48 and into the subsequent free space 49. However, the punch nose 52 stops just short of the orifice 48 before it retracts, leaving around the orifice 48 the small non-extruded portion adjacent the open end of the assembly. As the punch retracts, a typical knockout rod 53 then forces the blank 37 out of the die 46 for transfer to the next station 42. The blank 37 at this point has a cylindrical sidewall 56 and a generally flat, closed end 57 having a reduced radius 58 at the end adjacent the sidewall 56. The reduction at this stage will preferably be about half of the reduction to the final diameter, and the flared skirt portion 59 retains the original diameter of the cup and is the non-extruded portion that cannot pass through the orifice 48. The open end 61 now has a generally spherical recess 61 conforming to the punch nose 52.

At the next station 42, it is necessary to first reduce the flared skirt 59 before the final extrusion and reduction of diameter are performed so that the blank can be substantially trapped in a closed die during the extrusion operation. While FIG. 11 shows the operation at the second station 42 at the end of the cycle, FIGS. 11A and 11B show the intermediate stages. Station 42 has first and second axially spaced dies 64 and 66 to permit the intitial reduction in diameter of the flared skirt 59 on the blank 37, followed by the second and final extrusion of the complete blank. Although two dies 64 and 66 are shown as a matter of convenience, it is recognized that these dies could be formed as a single piece.

The first die 64 has an axial bore 67 having a diameter substantially the same as the diameter of the sidewall 56 of the blank 37 so that the blank slips into the bore 67 for its whole length. The outer end of the bore 67 is provided with a conical lead-in 68 to engage the outer surface of the flared skirt 59 and a suitable punch 69 has a shaped nose 70 having a reduced diameter spherical end to engage the recess 61 in the open end of the blank 37 to apply primary pressure to the core. As the punch 69 moves forward to the position shown in FIG. 11B, the flared skirt 57 is reduced in diameter to the rest of the sidewall 56 and the punch nose 70 now effectively traps the material of the blank, since the punch 69 has the same diameter as the bore 67, except for the necessary clearance.

It should be noted that the bore 67 is longer than the blank 37, even after the flared skirt 59 has been removed so that, as shown in FIG. 11B, the full diameter of the punch 69 has passed the lead-in 68 before the blank end face 57 reaches the second die 66. This second die 66 has a reduced diameter orifice 71 so that the extruded diameter of the blank as it passes the orifice is the final diameter of the electrode. The orifice 71 has a shoulder 72 at the outer end adjacent the first die 64, as well as a clearance space 73 on the other side, to receive the extruded blank at this station. A suitable knockout rod 74 is provided so that the extruded blank can be removed after the extrusion is completed.

As shown at station 42 in FIG. 11, at the end of the stroke of the punch 69, the blank has been extruded now into the clearance space 73 to produce a cylindrical sidewall 76 (see FIG. 8) of the blank 38, which now also has a slightly rounded end 77 and a flared skirt 78 defining a recess 79 at the open end of the blank 38. It should be noted at this point that the recess 79 has a depth substantially equal to that of the skirt 78 so that the core material is almost entirely within the reduced diameter sidewall portion 76.

The blank 38 is then transferred to the third station 43, where the trimming operation is performed. Station 43 includes a die 82 having an axial bore 83 substantially equal to the diameter of the blank 38, together with a flat, exposed end face 84. At the station 43 is located a flat punch 86 carried within a stripper sleeve 88, and a suitable knockout rod 89 is also provided. When the blank enters the bore 83, it passes freely therethrough until the skirt portion 78 abuts up against the end face 84 of die 83. Further movement of the punch 86 engaging against the recess 79 forces the blank further into the bore 83 so that the end face 84 shears off the skirt portion 78 to form a ring 90, and the resulting blank 39 has an exposed end face 91 in which the core material is exposed. When the punch is retracted, the stripper sleeve 88 then serves to force the ring 90 off the punch 86 so that the station is ready for the next part.

The blank 39 is then transferred to the fourth station 44, which has a die 93 also having a bore 94 of substantially the same diameter as the blank. At the outer end of bore 94 is an annular recess 95 and the punch 96 also has a recess 97 therein. Also at this station is a knockout rod 98 which, unlike the knockout rods at the other stations, is positioned to engage the end of the blank. The punch 96 is of substantially larger diameter than the blank, with the recess 97 having substantially the same diameter. Thus, when the blank is trapped between the punch 96 and the knockout rod 98, not only is the end adjacent the kockout rod 98 flattened and squared, but the material of both the core and the jacket is forced outward into the annular recess 95, since that is the only point at which the blank is unconfined.

Figure 10:
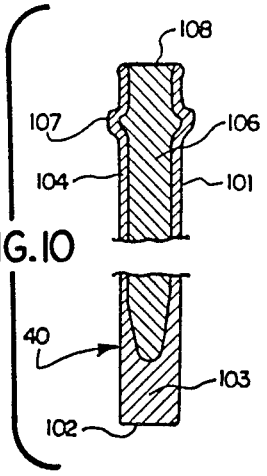

The resultant blank as ejected from station 44 has the configuration shown in FIG. 10, where the blank 40 has a cylindrical sidewall 101 and a flat end 102. The material that was the cup then makes up a solid portion 103 adjacent the flat end 102, so that the nickel alloy provides a solid portion adjacent the firing end of the electrode. The alloy material then forms a cover portion 104 of relatively reduced thickness overlying the core 106, which is exposed at the end 108. Adjacent this end, the material of both the jacket and the core forms an enlarged annular flange 107 suitable for securing the electrode within the finished spark plug.

Figure 12:
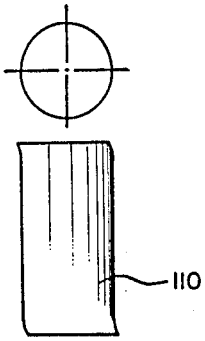
FIGS. 12–21 are views of the progressive steps similar to FIGS. 1–10, but according to another embodiment of the invention for forming an electrode without any trimming operation or leaving any scrap.
Figure 13:
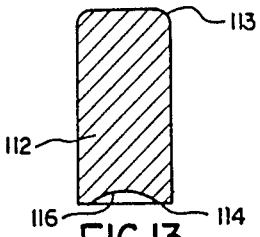
Figure 14:
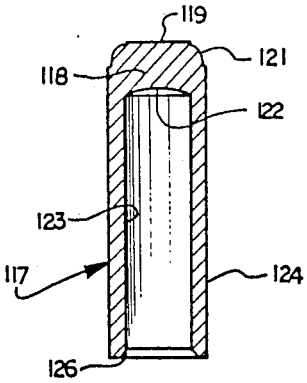

Another embodiment of the invention is shown in FIGS. 12–21, which, while substantially similar to the previously described embodiment, provides a scrapless method of making an electrode in which no trimming operation is required. The cup and the method of making it, as shown in FIGS. 12, 13, and 14, is preferably identical with the cup shown in FIGS. 1, 2, and 3, and begins with a slug 110 which is sheared from wire and then first undergoes a squaring operation to produce the squared blank 112 shown in FIG. 13. Again, the squared blank has a rounded end 113 and a squared end 114 having a spherical recess 116 therein.

The blank 112 is then formed into a cup 117, as shown in FIG. 14, by an extrusion operation, as previously described in connection with FIG. 3. The resultant cup 117 thus has an end wall 118 on the other side of which is an end face 119 of reduced diameter and a suitable radius 121 extending from its end face 119 to the cylindrical outer surface 124. The recess includes an inner end face 122 and a cylindrical inner surface 123 which extends to the open end 126.

Figure 15:
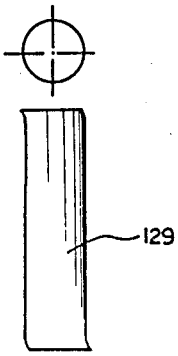
Figure 16:
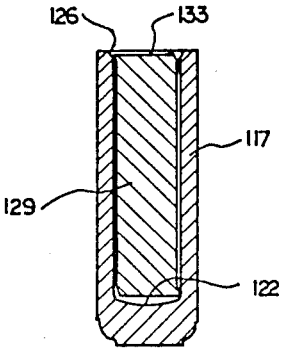
Figure 17:
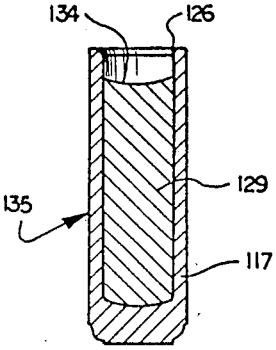
Figure 18:
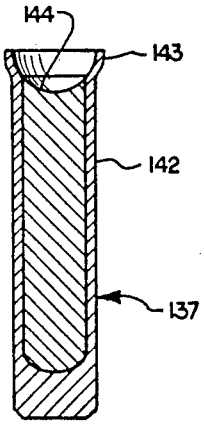
Figure 19:
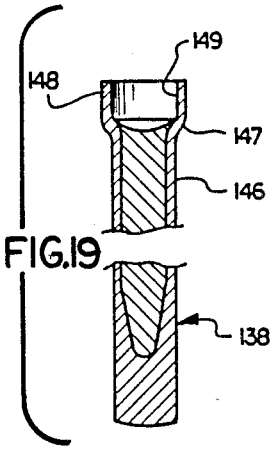
Figure 20:
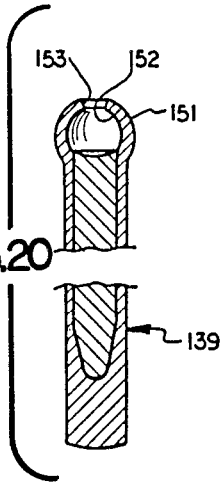
Figure 21:
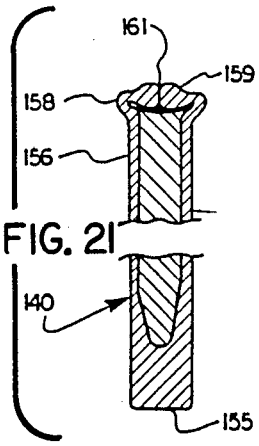

In a similar way, a core slug 129, as shown in FIG. 15, is formed from copper wire, but in this embodiment the core has a somewhat shorter overall length than that of the core slug 29 shown in FIG. 4. When the core slug 129 is then assembled loosely within the cup 117, as shown in FIG. 16, when the end of the core slug fits adjacent the recess bottom 122, the exposed end 133 of the core slug 129 will tend to be approximately flush with the open end 126 of the cup 117. After the staking operation is done to result in the assembly 135 shown in FIG. 17, with the core slug 129 upset to tightly fill the recess in the cup 117, the core end 134 is now recessed a substantial distance below the open end 126 of the cup 117.

The cup and core assembly 135 is then subjected to further operations similar to those shown in FIGS. 7 through 10 and utilizing tooling that is substantially identical, with minor changes as discussed hereinafter, to that shown in FIG. 11. The assembly 135 is extruded in a two-stage process, the first stage of which produces the blank 137 shown in FIG. 18. This blank has cylindrical outer wall 142 terminating adjacent the open end in a flaring skirt 143 defining therein a recess 144. It will be noted that this blank appears very similar to the blank shown in FIG. 7, except that, because of the reduced amount of material in the core, the recess 144 is substantially deeper than the recess 61 in the blank 37. At the next station, the blank 137 is further extruded and the skirt 143 reduced in diameter in a similar manner as shown in FIGS. 11A and 11B, and after the second extrusion the finished blank 138 has a cylindrical sidewall 146 having substantially the diameter of the finished electrode. At the upper end, the sidewall 146 terminates in a flaring skirt 147 having a cylindrical portion 148 adjacent the open end and defining a recess 149 therein.

The next step is to place the blank 138 in a supporting die having an annular recess at the open end and striking it with a punch also having a recess to perform a bottling or closing operation to produce the blank shown in 139. In this step, the core is not disturbed, but the skirt portion of the cup is formed inwardly at the open end defining a spherical head 151 enclosing a hollow recess 152 and defining a small centrally located opening 153 where the cup material has been constricted.

The final step is a heading operation in which the blank 139 is formed into the finished electrode 140. In this operation, the blank is fully enclosed and forced axially inward against a knockout rod to form a flat end 155 at the solid end of the electrode. The electrode retains the cylindrical sidewalls 156, which extend from the flat end 155 to an annular projecting rim 158, and a closed end 159 where the cup material has been gathered together and pressed downwardly to eliminate any air space within the electrode. The cup material is in contact with the exposed end of the core material, and the core is either completely enclosed or, at most, only a very small opening 161 is left in the center of the closed end 159. The finished electrode is then ready for further cleaning operations and thereafter for assembly into the finished spark plug.

Although the several preferred embodiments of this invention have been shown and described, it should be understood that various modifications and rearrangements may be resorted to without departing from the scope of the invention as claimed herein.

What is claimed is:

1. A method of forming a bimetal electrode for spark plugs or the like comprising forming a first metal into a cup having a central opening extending from an open end to a closed end, forming a core of a second metal different from said first metal, positioning said core in said central opening, seating said core in said cup so that said core deforms and engages the adjacent surface of said cup with the end of said core recessed within said open end to form a cup and core assembly, forming a first extrusion by pressing said assembly into a first extrusion die closed end first with tool applying force to said core and reducing said assembly from said closed end to a point adjacent said open end while leaving said open end unreduced, and thereafter forming a second extrusion by pressing said first extrusion into a second and smaller extrusion die closed end first to first reduce said unreduced portion to said first extrusion diameter by engaging said core with a tool having a diameter of said first extrusion and then reducing said assembly to said second diameter from said closed end back to a point adjacent said open end.

2. A method as set forth in claim 1, wherein said first metal is an alloy of nickel, chromium, and iron and said second metal is copper.

3. A method as set forth in claim 1, wherein said assembly after said second extrusion has a skirt portion adjacent said open end having a diameter equal to that of the first extrusion

4. A method as set forth in claim 3, including the step of trimming said skirt portion from the remaining portion of said assembly.

5. A method as set forth in claim 4, including the further step of upsetting an annular flange around the periphery of said assembly adjacent to but a spaced distance from said open end.

6. A method as set forth in claim 5, wherein during said further step the closed end of said assembly is squared by a punch.

7. A method as set forth in claim 3, including the subsequent step of bottling said skirt portion inwardly to at least partially cover said open end.

8. A method as set forth in claim 7, including the further step of pressing said bottled skirt portion against the exposed core material.

* * * * *